United States Patent [19]

Hensel

[11] Patent Number: 4,864,996

[45] Date of Patent: Sep. 12, 1989

[54] FUEL INJECTED TWO CYCLE ENGINE WITH PROGRESSIVE THROTTLE LINKAGE FOR IMPROVED RESOLUTION OF THROTTLE POSITION SENSOR

[75] Inventor: Robert J. Hensel, Oshkosh, Wis.

[73] Assignee: Brunswick Corporation, Skokie, Ill.

[21] Appl. No.: 180,048

[22] Filed: Apr. 11, 1988

[51] Int. Cl.[4] ..... F02B 33/04; F02M 35/10

[52] U.S. Cl. ..... 123/442; 123/336; 123/73 SC

[58] Field of Search ..... 123/52 M, 52 MC, 52 MV, 123/73 A, 73 SC, 308, 336, 432, 442, 494, 579, 583, 584

[56] References Cited

U.S. PATENT DOCUMENTS

| | | | |
|---|---|---|---|
| 2,420,925 | 5/1947 | Wirth | 123/583 |
| 4,280,465 | 7/1981 | Staerzl | 123/494 |
| 4,300,504 | 11/1981 | Tezuka | 123/442 X |
| 4,317,438 | 3/1982 | Yagi et al. | 123/432 |
| 4,378,761 | 4/1983 | Kawamura | 123/52 M |
| 4,590,897 | 5/1986 | Hundertmark | 123/73 A |
| 4,699,109 | 10/1987 | Hensel | 123/458 |
| 4,702,202 | 10/1987 | Hensel et al. | 123/52 M |
| 4,794,888 | 1/1989 | Lang | 123/73 SC |
| 4,794,889 | 1/1989 | Hensel | 123/73 SC |

*Primary Examiner*—Willis R. Wolfe

*Attorney, Agent, or Firm*—Andrus, Sceales, Starke & Sawall

[57] ABSTRACT

A two cycle crankcase compression fuel injected internal combustion engine has a first set of one or more throttle valves (104, 106) controlling combustion air flowing into the crankcase, and a second set of one or more throttle valves (110, 112) also controlling combustion air flowing into the crankcase. A throttle position sensor (104, 106) and controls fuel injection according to throttle position. Increased resolution of sensed throttle position at low engine speed is provided by admitting combustion air only through the first set of throttle valves (104, 106) and not through the second set of throttle valves (110, 112) at low engine speed for an initial given range of motion, such that greater movement of the first set of throttle valves (104, 106) is required to obtain a given amount of combustion air flow for a given engine speed, prior to opening the second set of throttle valves (110, 112), to provide more accurate fuel injection and better driveability. Progressive throttle linkage (200) is moveable to open the first set of throttle valves (104, 106) through a given range of motion prior to opening the second set of throttle valves (110, 112).

13 Claims, 6 Drawing Sheets

FUEL INJECTED TWO CYCLE ENGINE WITH PROGRESSIVE THROTTLE LINKAGE FOR IMPROVED RESOLUTION OF THROTTLE POSITION SENSOR

BACKGROUND AND SUMMARY

The invention relates to two cycle crankcase compression fuel injected internal combustion engines, and more particularly to accurate control of the fuel injection.

In a two cycle fuel injected internal combustion engine, the flow of combustion air into the crankcase of the engine is controlled by one or more throttle valves. A throttle position sensor, far example as shown in U.S. Pat. No. 4,280,465, incorporated herein by reference, senses rotation of the throttle valve shaft and provides such information to control circuitry which determines fuel injector pulse width. For accurate computation of the pulse width, good resolution of the throttle position is needed. This is difficult at low speed because small changes in throttle opening cause large changes in power and speed. In contrast, at higher speeds, a larger increase in throttle opening is needed to cause small changes in power and speed. There is a need for better resolution at low speed small throttle openings.

The present invention addresses and solves the above need. In an intake manifold having first and second sets of one or more throttle valves, for example as shown in U.S. Pat. No. 4,702,202, incorporated herein by reference, a progressive throttle linkage is provided in accordance with the present invention which is movable to open the first set of throttle valves through a given initial range of motion prior to opening the second set of throttle valves. In the preferred embodiment, the first set of throttle valves rotate through 50% of their motion before the second set of throttle valves begin to open. Both sets of throttle valves reach wide open throttle position substantially simultaneously. The throttle position sensor is coupled to the pivot shaft for the first set of throttle plates and controls fuel injection according to throttle position, to provide increased resolution of sensed throttle position at low engine speed because combustion air is flowing only through the first set of throttle valves and not through the second set of throttle valves, whereby greater movement of the first set of throttle valves is required to obtain a given amount of combustion air flow, prior to opening the second set of throttle valves. This provides more accurate fuel injection. The throttle position sensor is a potentiometer that has a linear scale over its entire 75° of throttle shaft rotation. Opening one set of throttle valves instead of two provides more throttle shaft rotation and hence greater throttle position sensor resolution, for a given engine speed. This also provides smoother throttle response and control by the operator.

BRIEF DESCRIPTION OF THE DRAWINGS

FIGS. 7A–E sequentially illustrate operation.

DETAILED DESCRIPTION

Figure 1:
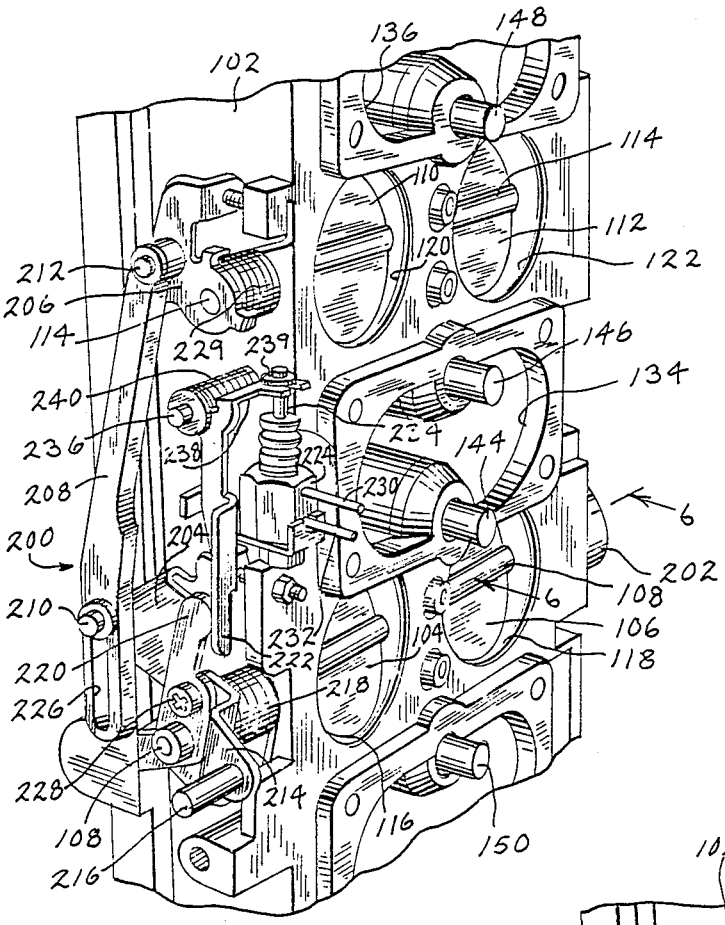
FIG. 1 shows a perspective view of an intake manifold and progressive throttle linkage for improved throttle position sensor resolution in accordance with the invention, and shows the throttle valves in a closed position.

FIG. 1 shows an intake manifold 102, corresponding to manifold 22 in incorporated U.S. Pat. No. 4,702,202, for a two cycle crankcase compression fuel injected internal combustion engine having a plurality of reciprocal pistons connected to a crankshaft in a crankcase, for example as shown in U.S. Pat. No. 4,702,202 at engine 2 having pistons 4 connected to vertical crankshaft 6 in crankcase 8. Manifold 102 has a lower set of throttle valve plates 104, 106 mounted to lower pivot shaft 108 which is rotatably journaled to the manifold, and also has an upper set of throttle valve plates 110, 112 mounted to pivot shaft 114 which is rotatably journaled to the manifold. Throttle valves 104, 106, 110, 112 control the flow of combustion air through respective throttle bore passages 116, 118, 120, 122. In U.S. Pat. No. 4,702,202, the throttle valves are shown at 40, and the throttle bore passages are shown at 30.

Figure 5:
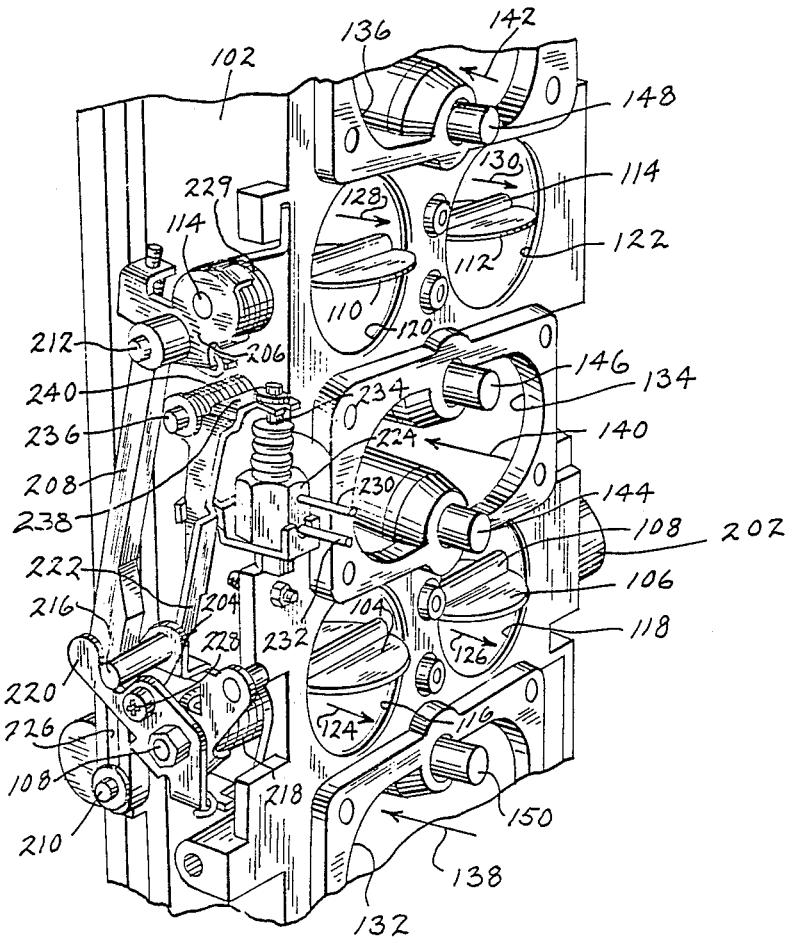
FIG. 5 is a view like FIG. 4 and shows the lower and upper throttle valves fully open.
Figure 6:
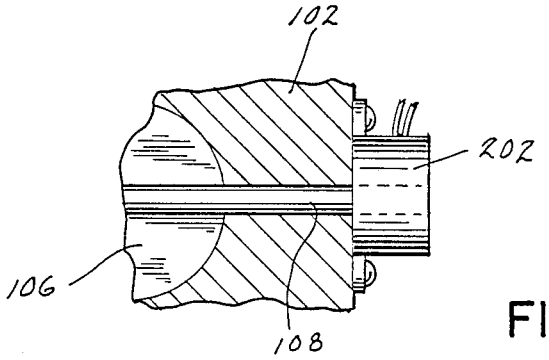
FIG. 6 is a view taken along line 6—6 of FIG. 1.

Intake manifold 102 is mounted by an adapter plate, as shown at 24 in U.S. Pat. No. 4,702,202, to the engine crankcase, on the left in the orientation of FIG. 1, which adapter plate spaces the manifold away from the crankcase by a gap as shown at 26 in U.S. Pat. No. 4,702,202 providing a passage defining an intake flow path laterally behind the manifold and adjacent the crankcase, i.e. between the manifold and crankcase as shown at air flow path 28 in FIG. 6 of U.S. Pat. No. 4,702,202. Intake combustion air then flows in a second direction away from the crankcase and rightwardly through throttle bores 116, 118, 120, 122 in FIG. 5 in the present application at air flow path arrows 124, 126, 128, 130, FIG. 5, and as shown at air flow path 32 in U.S. Patent 4,702,202. The intake combustion air flowing rightwardly in present FIG. 5 flows into a common plenum as shown at 42 in U.S. Pat. No. 4,702,202 provided by cover plate 60. The intake combustion air then flows in a third direction leftwardly in FIG. 5 through manifold passages 132, 134, 136 as shown at air flow paths 138, 140, 142, into the crankcase through the reed valves as shown at 10 in U.S. Pat. No. 4,702,202. Fuel injectors 144, 146 are mounted in passage 134, and in like manner a pair of fuel injectors are mounted in the other passages, one of which fuel injectors 148 is shown in passage 136, and one of which fuel injectors 150 is shown in passage 132. These fuel injectors are shown at 38 at U.S. Pat. No. 4,702,202. The fuel injectors inject fuel into the air flowing leftwardly through respective passages 132, 134, 136 to provide a fuel-air mixture into the crankcase. As noted in U.S. Pat. No. 4,702,202, for the V-6 engine shown, six fuel injectors are provided, one for each piston, and three supply passages 132, 134, 136 are provided, each having two fuel injectors. Four throttle bore passages 116, 118, 120, 122 are provided, each with a butterfly control valve 104, 106, 110, 112, respectively. Throttle bore passages 116, 118, 120, 122 and supply passages 132, 134, 136 interface at the common plenum 42 shown in U.S. Pat. No. 4,702,202 supplying combustion air for all the pistons.

FIG. 1 shows progressive throttle linkage 200 coupled to the lower set of throttle valves 104, 106 and to the upper set of throttle valves 110, 112 and movable to open the lower set of throttle valves through a given range of motion prior to opening the upper set of throttle valves. A throttle position sensor 202, Mercury Marine Part No. 148151, and for example above U.S. Pat. No. 4,280,465, is mounted to manifold 102 and senses rotation of throttle pivot shaft 108 to in turn control fuel injection through the control circuitry, as in U.S. Pat. No. 4,280,465. Fuel injection pulse width is controlled according to sensed throttle position. During the initial range of motion of the throttle linkage, combustion air flows only through the lower set of throttle valves 104, 106, and not through the upper set of throttle valves 110, 112. This provides increases resolution of sensed throttle position at low engine speed because greater movement of the lower set of throttle valve plates 104, 106 is needed to obtain a given amount of combustion air flow for a given engine speed, all prior to opening the upper set of throttle valve plates 110, 112. This provides more accurate fuel injection.

Linkage 200 includes a lower lever arm 204 extending from throttle pivot shaft 108, and an upper lever arm 206 extending from throttle pivot shaft 114. A link 208 is connected between lever arms 204 and 206 by respective trunnions 210 and 212 extending from such lever arms. Lever arm 204 has a separate non-integral arm 214 mounted on pivot shaft 108 and having a trunnion 216 to which an operator controlled cable linkage (not shown) is connected for pivoting lever arm 204 counterclockwise about pivot shaft 108. Lever arm 204 has an integral auxiliary arm 220 extending from lever arm 204 at pivot shaft 108. Auxiliary arm 220 has a slightly elongated slot 225, FIG. 7A, through which adjusting screw 228 extends into a threaded hole in arm 214, such that when screw 228 is loosened, arm 214 may be slightly rotated about pivot 108, without moving lever arm 204 and its integral auxiliary arm 220, to adjust the relative position of trunnion 216. Spring 218 biases lever arm 204 to a clockwise pivoted position with auxiliary arm 220 stopped against actuating arm 222 of a shut-off valve 224, to be described.

Figure 2:
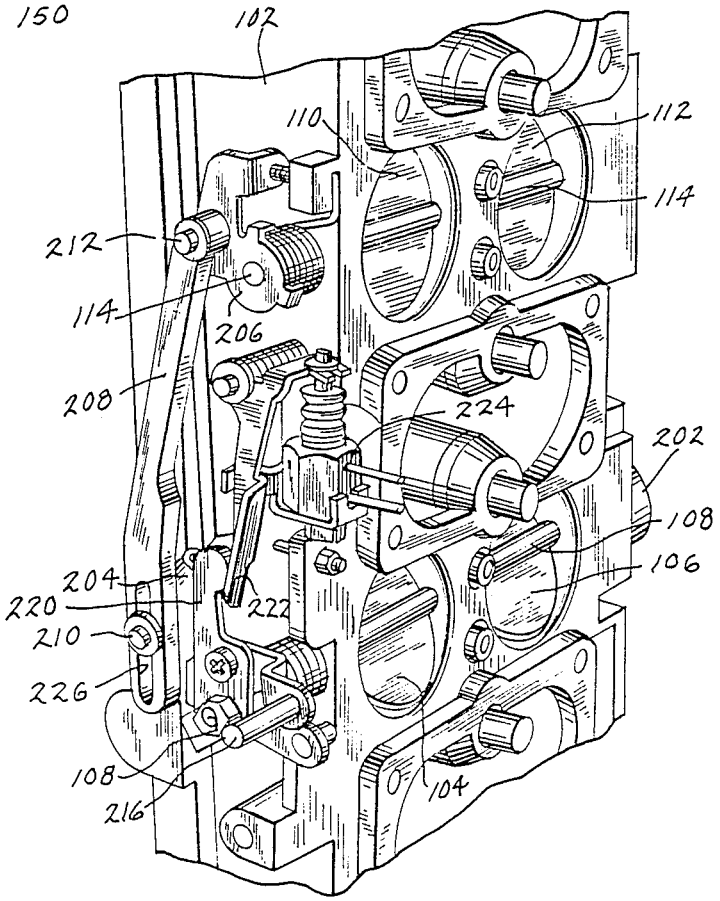
FIG. 2 is a view like FIG. 1 and shows the lower set of throttle valves beginning to open.
Figure 3:
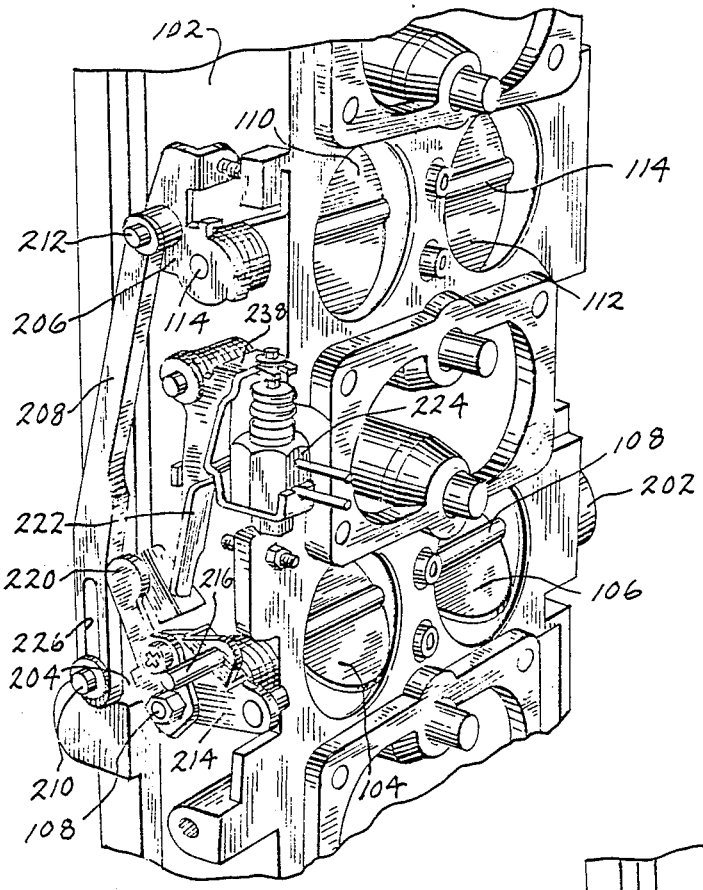
FIG. 3 is a view like FIG. 2 and shows the lower set of throttle valves further open, and the upper set of throttle valves ready to begin opening.
Figures 7A, 7B, 7C, 7D, 7E:
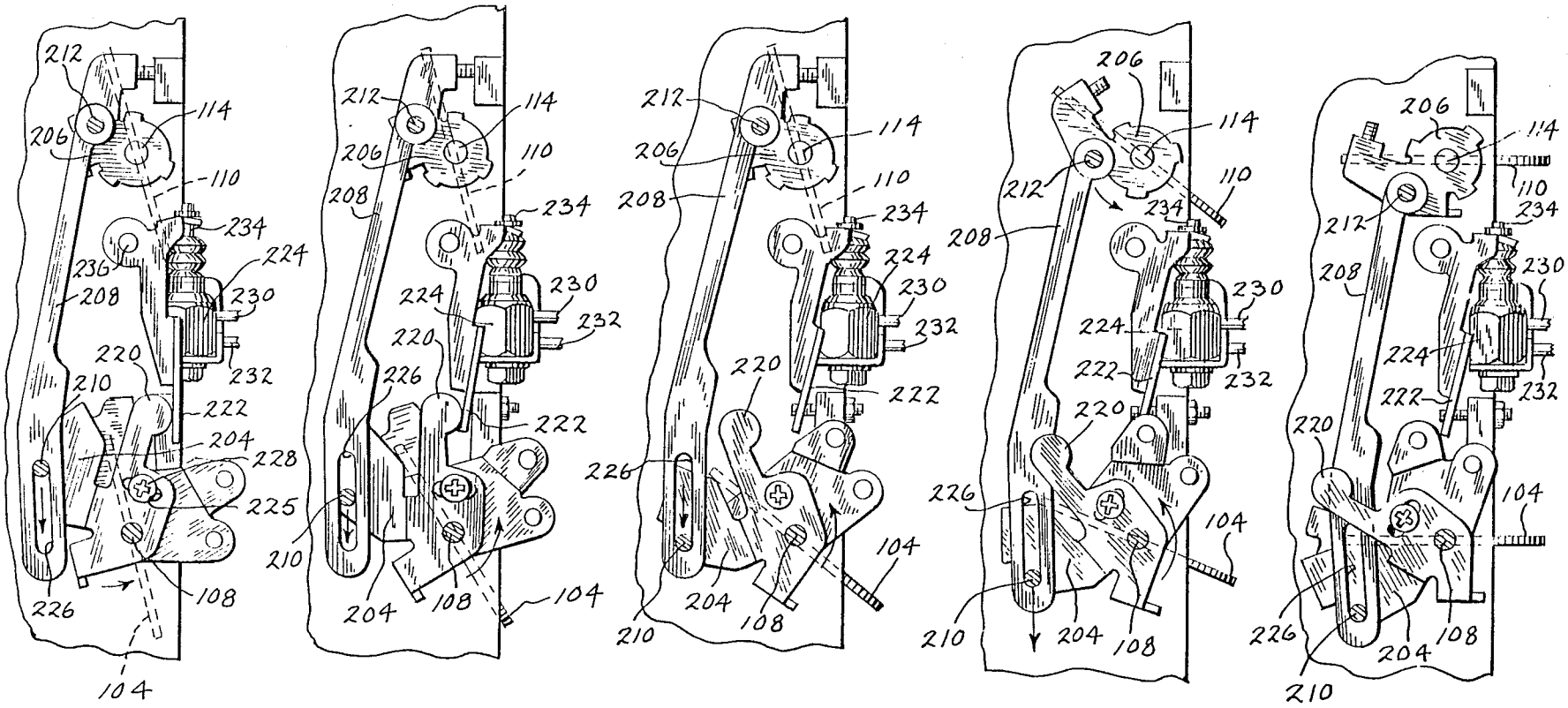
FIG. 7A is a side view of the structure of FIG. 1.
FIG. 7B is a side view of the structure of FIG. 2.
FIG. 7C is a side view of the structure of FIG. 3.
FIG. 7D is a side view of the structure of FIG. 4.
FIG. 7E is a side view of the structure of FIG. 5.

In operation, when lower lever arm 204 is pivoted counterclockwise about shaft 108 by pulling upwardly on trunnion 216, trunnion 210 at the end of lever arm 204 slides downwardly through lost motion elongated slot 226 in link 208, as shown in FIGS. 2 and 7B. During this motion, lower throttle valve plates 104, 106 begin to open, as shown by their slight counterclockwise rotation in FIGS. 2 and 7B. Upon further counterclockwise pivoting of lower lever arm 204, trunnion 210 moves further downwardly in slot 226 to the bottom end of such slot, as shown in FIGS. 3 and 7C. Lower throttle valve plates 104, 106 have now opened further, as shown in FIGS. 3 and 7C, but upper throttle valve plates 110, 112 have not yet opened. At the sequence stage shown in FIGS. 3 and 7C, the lost motion in slot 226 has been taken up by the downward movement of trunnion 210, and upper throttle valve plates 110, 112 are now ready to open.

Figure 4:
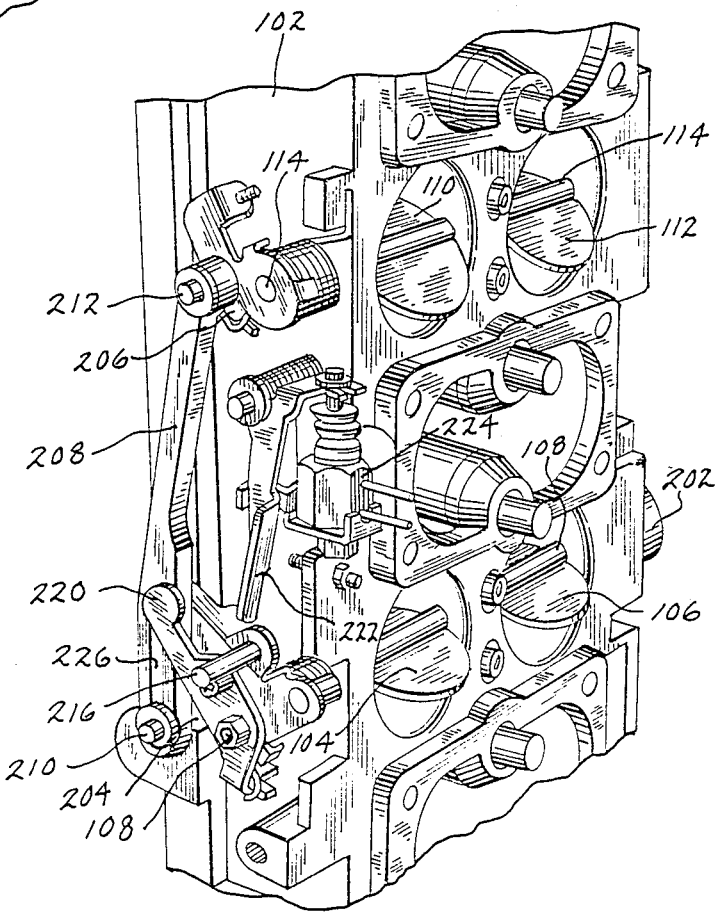
FIG. 4 is a view like FIG. 3 and shows further opening of the lower set of throttle valves, and opening of the upper sets of throttle valves.

Upon further counterclockwise pivoting of lower lever arm 204, trunnion 210 drives connecting link 208 downwardly, which in turn moves trunnion 212 downwardly, and hence pivots upper lever arm 206 counterclockwise to thus begin opening upper throttle valve plates 110, 112 against the bias of spring 228. FIGS. 4 and 7D show this condition with both the lower and upper sets of throttle valves partially open, though the lower set of throttle valves are closer to the fully open position. Continued counterclockwise pivoting of lower lever arm 204 drives connecting link 208 further downwardly to thus continue the pivoting of upper throttle valve plates 110, 112, and both the lower and upper sets of throttle valve plates reach the fully open position substantially simultaneously, FIGS. 5 and 7E. The length of upper lever arm 206 from pivot shaft 114 to trunnion 212 is shorter than the length of lower lever arm 204 from pivot shaft 108 to trunnion 210. Hence for a given length of motion of connecting link 208, upper throttle valve plates 110, 112 and pivot shaft 114 will pivot through a greater angle than lower throttle valve plates 104, 106 and lower pivot shaft 108. In this manner, the upper throttle valve plates 110, 112 pivot and open at a faster rate than the lower throttle valve plates 104, 106 in the sequence from FIGS. 3 through 5, and 7C through 7E.

Shut-off valve 224 is a Mercury Marine Part No. 20-18348 and is mounted to manifold 102 and connected in a puddled fuel return line for recirculating heavy fuel ends from low points in the crankcase, described hereinafter. Valve 224 has an inlet 230 connected to check valve 45, FIG. 9, and an outlet 232 connected to vapor separator inlet **44*b*. Valve 224 has a plunger 234 which in its upward extended position provides an open valve condition such that inlet 230 communicates with outlet 232. When plunger 234 is in its downward retracted position, valve 224 is closed which blocks communication from inlet 230 to outlet 232. Valve 224 is internally biased to urge plunger 234 downwardly to the closed condition. Actuating arm 222 is pivoted about shaft 236 and includes a portion 238 engaging plunger 234 along the underside of a flat disc washer 239 fixed to plunger 234. Spring 240 biases actuating arm 222 clockwise such that portion 238 is biased downwardly away from washer 239 and hence plunger 234 is normally retracted downwardly to its closed position. Spring 218 overcomes the bias of spring 240 and the internal bias of valve 224 to bias lower lever arm 204 and auxiliary arm 220 to a clockwise pivoted position engaging actuating arm 222 to thus pivot the latter counterclockwise and pull plunger 234 upwardly to hence open valve 224 at idle and low engine speed. At high engine speed, lower lever arm 204 is pivoted counterclockwise and hence auxiliary arm 220 is pivoted away from actuating arm 222 whereby the latter pivots clockwise due to spring 240 to thus permit plunger 234 to move downwardly due to the internal bias of valve 224 and hence close valve 224** at high engine speed.

The puddled fuel return line with a shut-off valve responsive to engine speed is the subject of co-pending application Ser. No. 180,046, filed on even date herewith, now U.S. Pat. No. 4,794,889 entitled "FUEL PUDDLE BLEED SHUT-OFF FOR FUEL INJECTED TWO CYCLE ENGINE". The shut-off valve is closed at high engine speed to prevent the flow at a high rate of a substantially gaseous medium to the vapor separator, to prevent fuel foaming otherwise caused thereby in the vapor separator and which would pass through the vapor vent line to the induction manifold, causing an over rich condition at high engine speed. At low engine speed, the shut-off valve is open, permitting flow of puddled fuel to the vapor separator, which flow is substantially more liquidic and at a lower rate.

Figure 8:
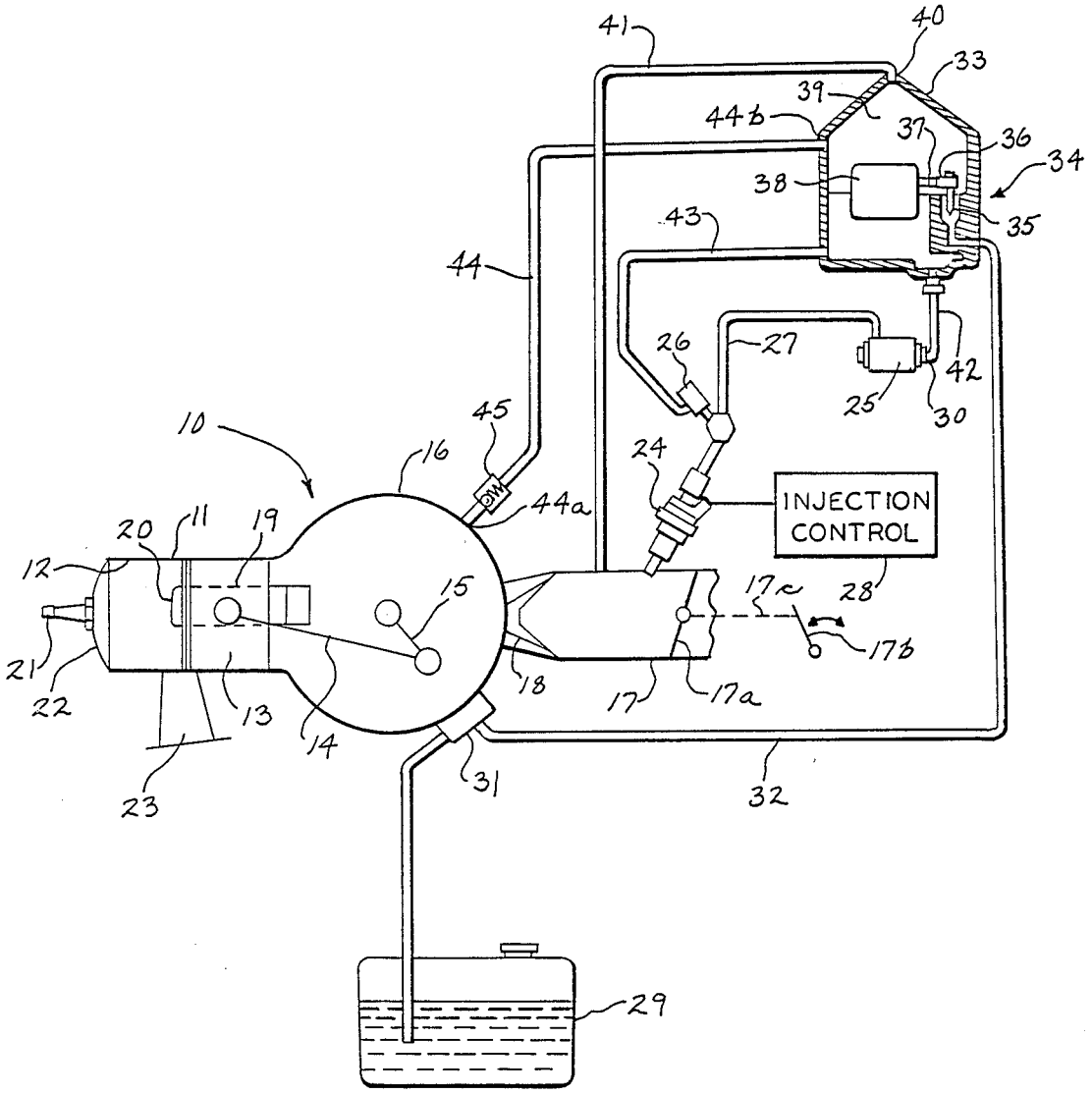
FIG. 8 PRIOR ART
FIG. 8 illustrates a fuel injection system known in the prior art.

FIG. 8 depicts known prior art and shows one cylinder of a two cycle crankcase compression internal combustion engine 10. The engine includes a cylinder block 11 having a cylinder bore 12 in which a piston 13 is supported for reciprocation. The piston 13 is connected by connecting rod 14 to crankshaft 15 which is journaled for rotation in crankcase 16 of engine 10. The engine includes an induction system with air intake manifold 17 having throttle valve **17*a* and supplying combustion air to crankcase 16. One-way reed check valve 18 permits flow from manifold 17 into crankcase 16, and prevents reverse flow out of crankcase 16 into manifold 17. A transfer passage 19 extends from crankcase 16 through cylinder block 11 and terminates at inlet port 20 in the cylinder wall at a point above the bottom dead center position of piston 13. A spark plug 21 is provided in the cylinder head 22 for firing the fuel-air charge. An exhaust port 23 is formed in cylinder bore 12** to discharge exhaust gases to the atmosphere.

Engine 10 is provided with a fuel injection system that includes an electromagnetically controlled injection nozzle 24 that discharges into induction manifold 17. Fuel, typically gasoline, is supplied to nozzle 24 by a high pressure fuel pump 25. A pressure regulator 26 is provided on the fuel supply line 27 to maintain an essentially constant fuel pressure at fuel injection nozzle 24. An electronic control 28 is provided to control the operation of injection nozzle 24 in known manner to deliver the desired amount of fuel to induction manifold 17 at the desired times.

During running of the engine, air is delivered to induction manifold 17 and fuel is injected by nozzle 24 to provide a fuel-air mixture which is admitted to crankcase 16 through reed valve 18 while piston 13 is moving upwardly toward spark plug 21. Reed valve 18 will open during these conditions as long as the pressure in crankcase 16 is lower than that in induction manifold 17. As piston 13 moves downwardly toward crankcase 16, exhaust port 23 will open to discharge spent combustion products, and intake port 20 will open to allow transfer of fuel-air mixture from crankcase 16 to cylinder 12. On the upstroke of piston 13, spark plug 21 is fired to ignite the mixture, and the cycle continues in conventional manner.

A vapor free supply of fuel from a remote fuel tank 29 is provided to the inlet 30 of high pressure fuel pump 25. A low pressure fuel pump 31, such as a diaphragm pump operated by the pulsating pressure in the engine's crankcase 16, is used to draw fuel from fuel tank 29. Such diaphragm pumps are commonly used on outboard motors and produce a fuel output closely matched to engine requirements. From the lower pressure pump 31 fuel is supplied by a fuel line 32 to a vapor separator 33. Admission of fuel from low pressure pump 31 to vapor separator 33 is controlled by a float operated valve 34. The valve member 35 is controlled by a lever 36 having a pivot point 37 fixed on the vapor separator 33 and attached to a float 38. The level of fuel in the vapor separator chamber 39 is thus controlled by the float operated valve 34. An opening 40 at the top of vapor separator chamber 39 is connected by a line 41 to induction manifold 17. The inlet 30 of high pressure fuel pump 25 is connected by fuel line 42 to draw fuel from the bottom of the vapor separator chamber 39. An excess fuel return line 43 from pressure regulator 26 returns excess fuel to the vapor separator chamber 39 for recirculation.

A puddled fuel return line 44 has an inlet **44*a* connected to a low point of crankcase 16 and has an outlet 44*b* connected to vapor separator 33. Other puddle return fuel lines are connected to vapor separator 33 from each crankcase section of the respective remaining cylinders of the engine for recirculation of puddled fuel including heavy fuel ends. During the combustion power stroke of piston 13 away from spark plug 21, the puddled fuel is pumped from crankcase 16 through one-way check valve 45 to vapor separator 33 for recirculation. Valve 45 prevents reverse flow through line 44 back into crankcase 16**.

In operation, low pressure fuel pump 31 supplies fuel to vapor separator 33 through float controlled valve 34. The pressure in vapor separator 33 at the surface of the fuel will be held at or below atmospheric pressure by the connection through line 41 to induction manifold 17. Thus, fuel which vaporizes will be drawn from separator 33 and supplied through line 41 to induction manifold 17. Hence, vapor free fuel will be supplied through line 42 to inlet 30 of high pressure fuel injection pump 25. Separator 33 is also effective to remove vapors from the excess fuel returned to separator 33 from pressure regulator 26 through excess fuel return line 43. Separator 33 is also effective to remove vapors from the puddled fuel returned to separator 33 from crankcase 16 through puddled fuel return line 44.

Figure 9:
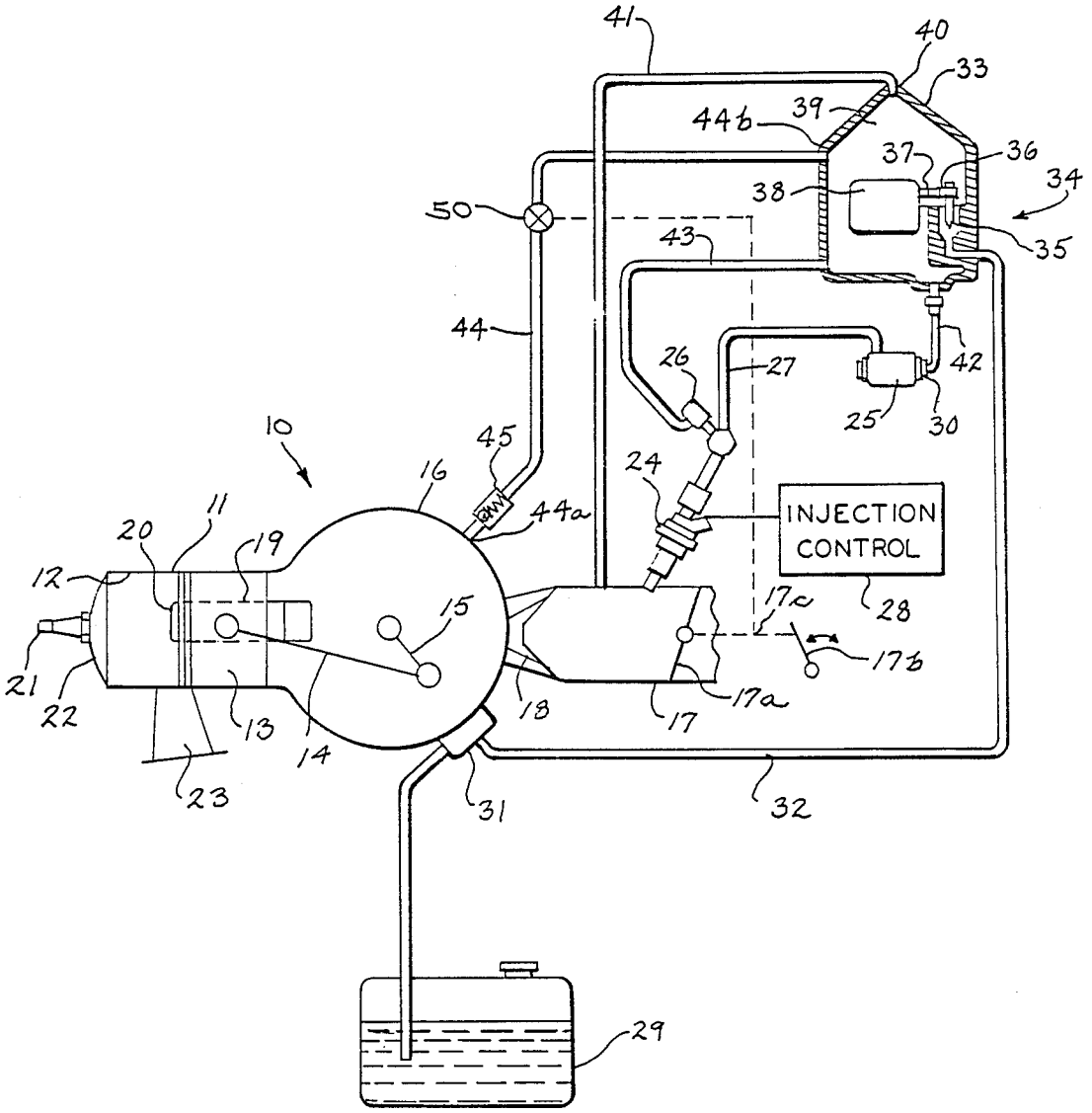
FIG. 9 illustrates a fuel puddle bleed shut-off system in accordance with co-pending application Ser. No. 180,046, filed on even date herewith, now U.S. Pat. No. 4,794,889, entitled "FUEL PUDDLE BLEED SHUT-OFF FOR FUEL INJECTED TWO CYCLE ENGINE".

FIG. 9 shows a marine fuel system in accordance with the noted co-pending application, and uses like reference numerals from FIG. 8 where appropriate to facilitate clarity. A shut-off valve 50, which is valve 224 in FIGS. 1–7, is provided in puddled fuel return line 44, and is controlled by throttle linkage **17*c* which also controls throttle 17*a*. This throttle linkage is shown at 200 in FIGS. 1–7. Valve 50 has a closed condition at high engine speed, and an open condition at low engine speed. At high engine speed, the high flow rate substantially gaseous flow is blocked from reaching the fuel system, to prevent fuel foaming in vapor separator 33, and hence prevent the passing of foamed fuel through vapor vent line 41 to induction manifold 17, otherwise causing an over-rich mixture. At low engine speed, the flow from the crankcase through puddle fuel return line 44 is substantially more liquidic and of a much lower rate, and is allowed to flow to vapor separator 33**.

It is recognized that various equivalents, alternatives and modifications are possible within the scope of the appended claims.

I claim:

1. A two cycle internal combustion fuel injected engine having a plurality of reciprocal pistons connected to a crankshaft in a crankcase and having a first set of at least one throttle valve controlling combustion air flowing into said crankcase and a second set of at least one throttle valve controlling combustion air flowing into said crankcase, progressive throttle linkage coupled to said first and second sets of throttle valves and movable to open said first set of throttle valves through a given range of motion prior to opening said second set of throttle valves.

2. The invention according to claim 1 comprising differential actuation means responsive to continued movement of said progressive throttle linkage after opening said first set of throttle valves through said given range of motion to continue opening said first set of throttle valves and to open said second set of throttle valves at a faster rate than said first set of throttle valves.

3. The invention according to claim 2 wherein said first and second sets of throttle valves reach full open substantially simultaneously.

4. The invention according to claim 1 comprising an intake manifold mounted to said engine and having a common plenum chamber, said first and second sets of throttle valves being mounted to said intake manifold, and wherein combustion air flows through said first and second sets of throttle valves to said common plenum and then into said crankcase, and comprising a throttle position sensor coupled to said first set of throttle valves and controlling fuel injection according to throttle position, and providing increased resolution of sensed throttle position at low engine speed during said given range of motion prior to opening said second set of throttle valves by requiring greater movement of said first set of throttle valves to obtain a given amount of combustion air flow into said common plenum without combustion air flow through said second set of throttle valves, to provide more accurate fuel injection.

5. The invention according claim 4 wherein said first set of throttle valves are mounted on a first pivot shaft mounted to said intake manifold, and said second set of throttle valves are mounted on a second pivot shaft mounted to said intake manifold, and wherein said throttle linkage comprises a first lever arm extending from said first pivot shaft and a second lever arm extending from said second pivot shaft, and connecting link means extending between said lever arms, and wherein said second lever arm is shorter than said first lever arm such that said second pivot shaft pivots through a greater angle than said first pivot shaft for the same motion of said connecting link means such that said second set of throttle valves swing through greater arcs and open faster than said first set of throttle valves after said initial given range of motion of said first set of throttle valves.

6. The invention according to claim 5 comprising lost motion means cooperating between said connecting link means and said first lever arm to provide said initial given range of motion of said first set of throttle valves by taking up lost motion.

7. The invention according to claim 6 wherein said lost motion means comprises an elongated slot in said connecting link means and a trunnion on said first lever arm such that said first lever arm is pivoted through said initial given range of motion with said trunnion moving through said slot, and such that upon further pivoting of said first lever arm said trunnion engages an end of said slot and moves said connecting link means which in turn moves said second lever arm and pivots said second pivot shaft to open said second set of throttle valves.

8. A two cycle crankcase compression internal combustion engine having a plurality of reciprocal pistons connected to a crankshaft in a crankcase, an induction system supplying combustion air to said crankcase, fuel injection means mixing fuel with the combustion air, a fuel tank, fuel pump means connected to draw fuel from said fuel tank and supply fuel under pressure to said fuel injection means, pressure regulator means regulating the output pressure of said fuel pump means at said fuel injection means and returning excess fuel through an excess fuel return line to said fuel pump means for recirculation, a puddle removal system comprising a puddle fuel return line having an inlet connected to said crankcase and receiving puddled fuel including heavy fuel ends, and having an outlet connected to return puddled fuel to said fuel pump means for recirculation, wherein substantially all of the fluid flow in said puddled fuel return line from said crankcase is gaseous at high engine speed, and is more liquidic at low engine speed, a shut-off valve in said puddled fuel return line and having a closed condition at high engine speed blocking said gaseous flow from said crankcase through said puddled fuel return line, and having an open condition at low engine speed permitting fluid flow from said crankcase through said puddled fuel return line, said induction system including an intake manifold having a common plenum chamber, a first set of at least one throttle valve mounted on a first pivot shaft to said intake manifold and controlling combustion air flowing into said crankcase, a second set of at least one throttle valve mounted on a second pivot shaft to said intake manifold and controlling combustion air flowing into said crankcase, wherein combustion air flows through said first and second sets of throttle valves to said common plenum and then into said crankcase, throttle linkage means comprising a first lever arm extending from said first pivot shaft and a second lever arm exending from said second pivot shaft and connecting link means extending between said lever arms, and wherein said shut-off valve is mounted to said intake manifold and has an actuating arm engaged by said first lever arm to control said shut-off valve between said closed and open conditions.

9. The invention according to claim 8 comprising biasing means biasing said actuating arm of said shut-off valve to a normally closed condition, and wherein said first set of throttle valves have a normally closed position with said first lever arm engaging said actuating arm and moving the latter against the bias of said biasing means to the open condition of said shut-off valve, and wherein said first lever arm moves away from said actuating arm upon opening said first set of throttle valves to enable said biasing means to move said actuating arm to the closed condition of said shut-off valve, such that said shut-off valve is open when said first set of throttle valves is closed and such that said shut-off valve is closed when said first set of throttle valves is open.

10. The invention according to claim 9 wherein said second lever arm is shorter than said first lever arm and wherein said first lever arm is movable through a given range of motion to open said first set of throttle valves prior to opening said second set of throttle valves, said second lever arm being shorter than said first lever arm such that after said initial given range of motion of said first set of throttle valves, the latter continue to open and said second set of throttle valves also open and at a faster rate than continued opening of said first set of throttle valves.

11. A two cycle internal combustion fuel injected engine having a plurality of reciprocal pistons connected to a crankshaft in a crankcase, fuel supply means comprising fuel injection means, a low profile intake manifold mounted to said crankcase and defining passage means for intake combustion air flowing in a first direction adjacent said crankcase and then flowing in a second direction away from said crankcase and then flowing in a third direction toward and into said crankcase, a first set of at least one throttle valve controlling combustion air flowing in said second direction, a second set of at least one throttle valve controlling combustion air flowing in said second direction, progressive throttle linkage coupled to said first and second sets of throttle valves and movable to open said first set of throttle valves through a given initial range of motion prior to opening said second set of throttle valves.

12. The invention according to claim 11 wherein said first direction is transverse to said crankshaft, said second direction is transverse to said first direction and to said crankshaft, said third direction is opposite and parallel to said second direction, said first direction is defined by at least one first passage between said crankcase and said manifold, said second direction is defined by second passages having said throttle control valves for controlling the amount of combustion air flowing therethrough, said third direction is provided by third passages into said crankcase, wherein said second and third passages interface at a common plenum in said intake manifold supplying combustion air for all of said pistons, a throttle position sensor coupled to said first set of throttle valves and controlling fuel injection according to throttle position to provide increased resolution of sensed throttle position at low engine speed by supplying combustion air to said common plenum through said first set of throttle valves but not through said second set of throttle valves, whereby to require greater movement of said first set of throttle valves to obtain a given amount of combustion air flow prior to opening said second set of throttle valves, to provide more accurate fuel injection.

13. The invention according to claim 12 wherein said first set of throttle valves are mounted on a first pivot shaft to said intake manifold, said second set of throttle valves are mounted on a second pivot shaft to said intake manifold, said throttle linkage comprises a first lever arm extending from said first pivot shaft and a second lever arm extending from said second pivot shaft, and connecting link means extending between said lever arms, and wherein said second lever arm is shorter than said first lever arm such that after said initial given range of motion of said first set of throttle valves said second pivot shaft pivots through a greater angle than said first pivot shaft for the same movement of said connecting link means such that said second set of throttle valves opens at a faster rate than said first set of throttle valves.

* * * * *